US005555585A

United States Patent [19]

Fowler

[11] Patent Number: 5,555,585

[45] Date of Patent: Sep. 17, 1996

[54] PNEUMATIC GUN AND PROJECTILES THEREFOR

[75] Inventor: Jeffrey B. Fowler, Bedford, Australia

[73] Assignee: Compri Technic Pty., Ltd., Bayswater, Australia

[21] Appl. No.: 276,615

[22] Filed: Jul. 18, 1994

Related U.S. Application Data

[62] Division of Ser. No. 983,849, filed as PCT/AU91/00352, Mar. 3, 1993, Pat. No. 5,329,660.

[30] Foreign Application Priority Data

| | | | |
|---|---|---|---|
| Aug. 10, 1990 | [AU] | Australia | PK 1710 |
| Nov. 15, 1990 | [AU] | Australia | PK 3364 |

[51] Int. Cl.[6] ..... B08B 9/04

[52] U.S. Cl. ..... 15/3.5; 15/104.061; 15/104.062

[58] Field of Search ..... 15/104.061, 104.062, 15/104.063, 3.5, 3.51, 3.52

[56] References Cited

U.S. PATENT DOCUMENTS

| | | | |
|---|---|---|---|
| 1,547,440 | 7/1925 | Penn | 15/104.061 |
| 1,806,270 | 5/1931 | Thompson . | |
| 1,867,751 | 7/1932 | Oberhuber | 15/3.5 |
| 2,906,650 | 9/1959 | Wheaton | 15/104.061 |
| 3,229,400 | 1/1966 | Pozo, Jr. . | |
| 3,403,418 | 10/1968 | Knapp et al. . | |
| 3,605,159 | 9/1971 | Girard | 15/104.061 |
| 3,631,555 | 1/1972 | Hurst . | |
| 3,725,968 | 4/1973 | Knapp et al. . | |
| 3,913,844 | 10/1975 | Petrovic . | |
| 4,077,079 | 3/1978 | Knapp | 15/104.061 |
| 4,252,255 | 2/1981 | Henderson | 15/3.5 |
| 4,383,346 | 5/1983 | Bochinski et al. . | |
| 4,406,030 | 9/1983 | Platts . | |
| 4,467,488 | 8/1984 | Creek | 15/3.5 |
| 4,569,097 | 2/1986 | Echols | 15/104.061 |
| 4,974,277 | 12/1990 | Casella | 15/3.5 |

FOREIGN PATENT DOCUMENTS

| | | | |
|---|---|---|---|
| 0041699 | 12/1981 | European Pat. Off. . | |
| 0286320 | 10/1988 | European Pat. Off. . | |
| 522895 | 4/1931 | Germany | 15/104.061 |
| 1295933 | 5/1969 | Germany . | |
| 2064708 | 7/1971 | Germany . | |
| 517532 | 1/1972 | Switzerland . | |

*Primary Examiner*—Mark Spisich
*Attorney, Agent, or Firm*—Larson and Taylor

[57] ABSTRACT

A hand held pneumatic gun has an airway arranged to be coupled to a source of compressed air, the airway communicating with an air chamber via a trigger valve assembly. The gun includes a detachable breech that is supported in a sealed position against the air chamber by a support ring pivotally secured to the body of the gun. An interlocking assembly is arranged to interlock with the trigger valve assembly if the breech is not supported in its sealed position, so that actuation of the trigger valve assembly is inhibited unless the breech is sealed against the air chamber. The breech incorporates a nozzle that can be secured to an end of a hose or tube and a polymer projectile is placed into the breech to be forced by the air pressure through the hose or tube to clean the interior of the hose or to remove contaminate matter therefrom.

12 Claims, 4 Drawing Sheets

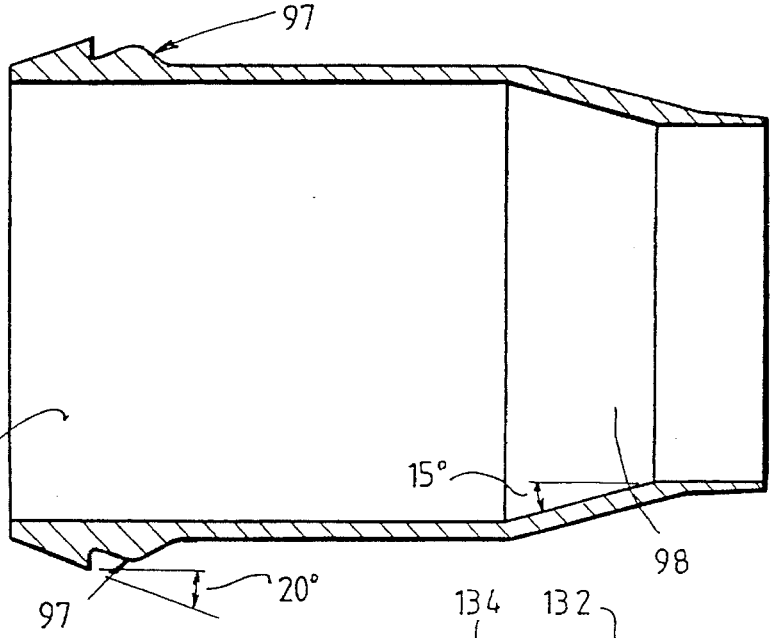
FIG. 9.
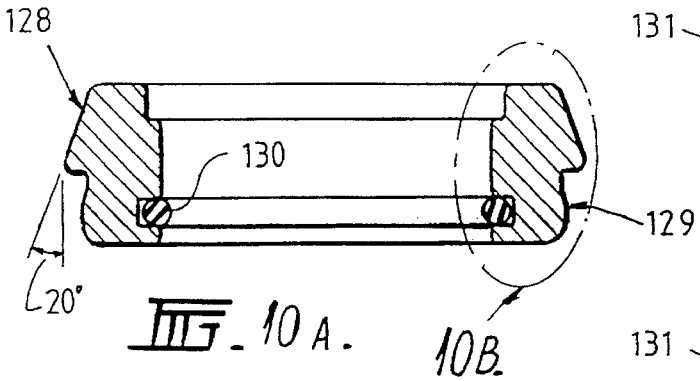
FIG. 10A.
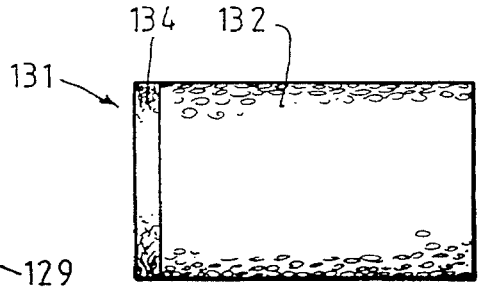
FIG. 11.
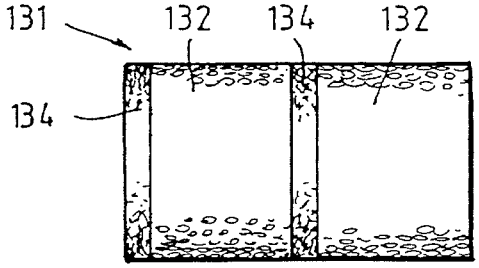
FIG. 12.
FIG. 10B.
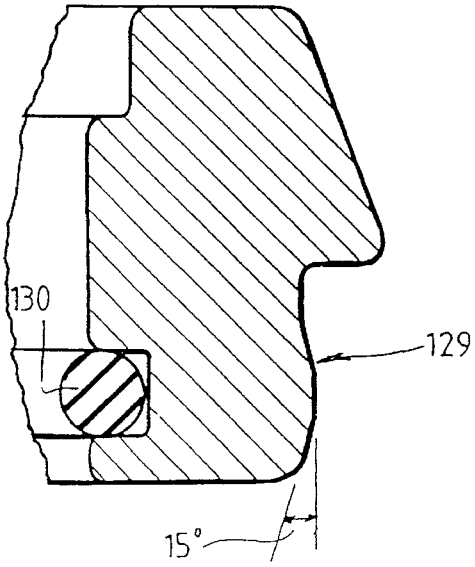
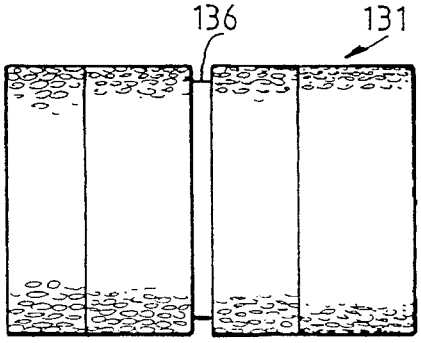
FIG. 13.

PNEUMATIC GUN AND PROJECTILES THEREFOR

This is a division of application Ser. No. 07/983,849 filed as PCT/AU91/oo352, Mar. 3, 1993, now U.S. Pat. No. 5,329,660.

FIELD OF THE INVENTION

The present invention relates to a pneumatic gun and relates particularly to a gun for use in the internal cleaning of a hose or tube with compressed air.

BACKGROUND TO THE INVENTION

The problem of keeping a hose, tube or pipe work internally clean is a perennial problem. Where the hose or tube is used for example in the food industry or in a medical environment, it becomes critical that the lines remain clean. Similarly, in hydraulic and pneumatic lines internal contamination can cause breakdown and costly down time. There are many other situations in other industries which employ hose, tube, conduit or piping where internal cleaning is essential, or would result in substantial savings by eliminating replacement costs.

A very efficient known means of cleaning hose and tube is to force a compressible projectile, that has an outside diameter greater than the internal diameter of the hose or tube, therethrough under pressure. The projectile as it travels along the hose or tube thus removes particulate material from the internal wall. A number of projectiles can be repeatedly passed through lengths of the hose or tube under pressure to ensure that all contaminate matter has been removed. The usual means of effecting this cleaning operation is to place the projectile in a compressed air gun and then to operate a valve causing compressed air to flow through the gun and enter the tube via a nozzle that is coupled to the end of the hose or tube. The compressed air forces the projectile through the nozzle into and along the tubes to clean the interior of the pipe.

A problem with this type of equipment is that for the system to work satisfactorily, by ensuring that the projectile does not get stuck in the hose or tube, it is most important that there is no air loss between the gun and the tube. Since hose and tube comes in a variety of diameters and materials there is a need for a pneumatic gun that can be adapted simply for use over a range of hose products.

In commonly assigned U.S. Pat. No. 4,974,277 a hand held pneumatic gun is described, having an airway that is coupled to a source of compressed air, the airway communicating with an air chamber via a trigger valve. The gun includes a detachable breech that is supported in sealed engagement against the air chamber by a support ring pivotally secured to the body of the gun. The breech incorporates a nozzle that is secured to one end of a piece of hose or tube and a polymer projectile is placed into the breech to be forced by the air pressure through the hose or tube to clean the interior of the hose or tube.

Although the above hand held pneumatic gun was extremely well received and well adapted to its function, a number of problems have emerged during use of the gun. The present invention is concerned with a number of improvements to the gun which have been made with a view to overcoming these problems responsive to end-users requirements.

The present invention is also concerned with several improved types of projectile employed with the pneumatic gun.

SUMMARY OF THE INVENTION

According to one aspect of the present invention there is provided a hand held pneumatic gun having an airway arranged to be coupled to a source of compressed air, the airway communicating with an air chamber via a trigger valve means, a detachable breech adapted to be supported in a sealed position in which the breech is sealed against the air chamber, and an interlocking assembly arranged to interlock with said trigger valve means if said breech is not supported in its sealed position whereby, in use, actuation of the trigger valve means to allow passage of compressed air is inhibited unless the breech is sealed against the air chamber.

Preferably the breech is coaxially supported by a support ring movable from an open position, where the breech can be detached, to a closed position where the breech is sealed against the air chamber, and wherein said interlocking assembly interlocks with said trigger valve means if said support ring is not fully returned to its closed position.

Advantageously a releasable latch is arranged to engage the support ring in the closed position. Preferably the interlocking assembly comprises a pivotable member operatively connected to said trigger valve means and adapted to pivot upon actuation of the trigger valve means whereby, in use, if said support ring is not fully returned to its closed position said pivotable member engages said releasable latch to inhibit actuation of said trigger valve means.

According to another aspect of the present invention there is provided a projectile for the above pneumatic gun in the form of a pellet comprising:

a cylindrical portion of foamed plastics material; and, one or more layers of abrasive material bonded to the cylindrical portion to enhance the cleaning properties of the pellet.

According to a still further aspect of the present invention there is provided a projectile for the above pneumatic gun in the form of a pellet comprising:

a cylindrical portion of foamed plastics material characterised in that it consists of a plurality of layers of foamed plastics material wherein each layer has a different density from its adjacent layer.

Preferably said layers extend substantially perpendicular to the normal direction of travel of the projectile.

Preferably said layers are laminated in order of increasing or decreasing density. Typically the density of the layers of foamed plastics material varies in the range 80 to 200 kg.

BRIEF DESCRIPTION OF THE DRAWINGS

In order that the nature of the improvements to the pneumatic gun and projectiles may be more clearly ascertained, a preferred embodiment of the gun and projectiles will now be described, by way of example only, with reference to the accompanying drawings in which:

FIG. 9 illustrates another breech/nozzle that doesn't require an adaptor ring;

FIGS. 10 (A) and (B) illustrate an adaptor ring for the breech/nozzles illustrated in FIG. 8;

FIGS. 11 and 12 illustrate two types of improved projectile with one or more abrasive layers; and, FIG. 13 illustrates a different type of improved projectile.

DETAILED DESCRIPTION OF PREFERRED EMBODIMENTS

Figure 1:
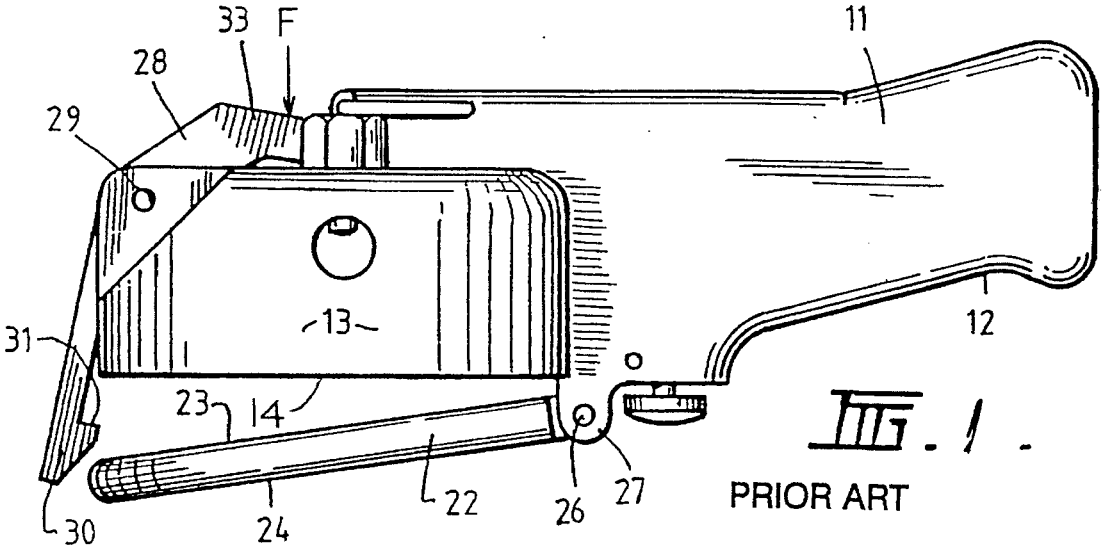
FIG. 1. PRIOR ART
FIG. 1 is a side elevation of a prior art gun with a support ring in an unlatched position.
Figure 2:
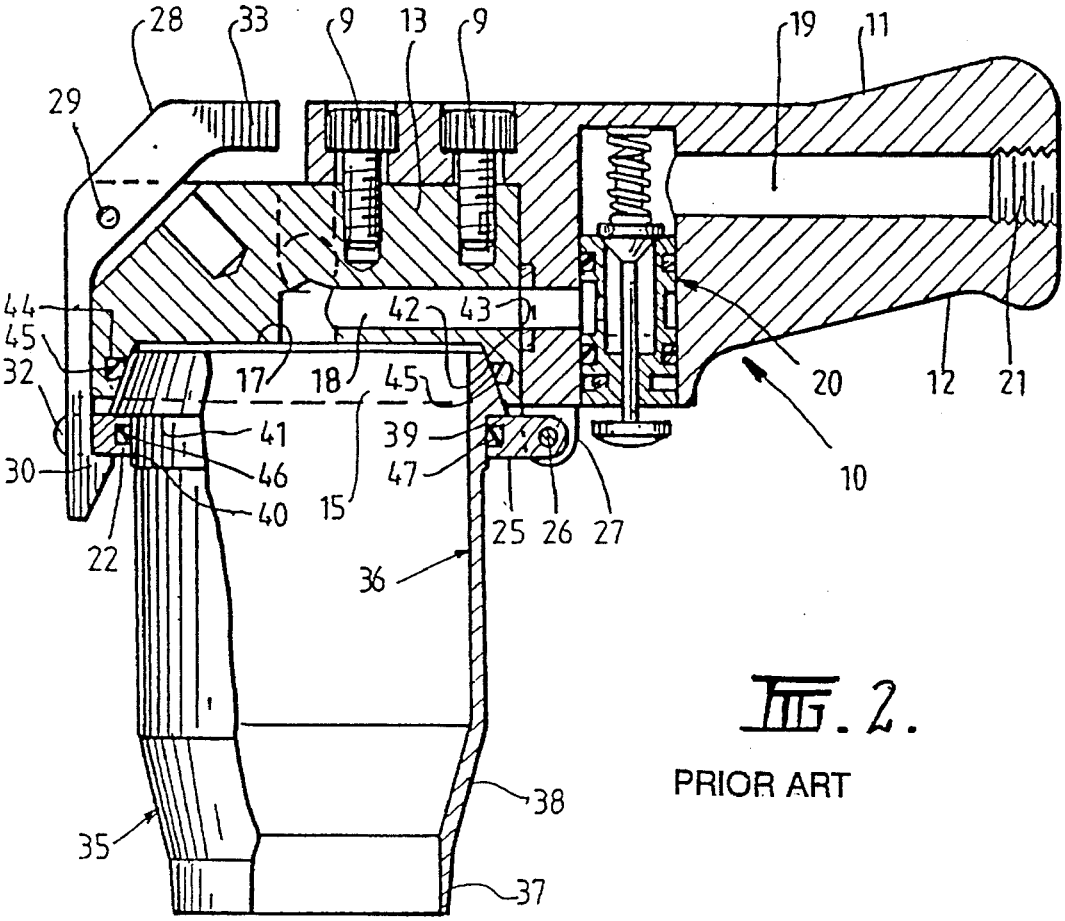
FIG. 2. PRIOR ART
FIG. 2 is a cross section view of the gun in FIG. 1 with a breech/nozzle assembly attached.

FIGS. 1 and 2 in the accompanying drawings illustrate the prior art pneumatic gun 10 described in commonly owned U.S. Pat. No. 4,974,277. The gun 10 comprises a handle 11 including a finger grip portion 12 that is bolted to main body portion 13 by set screws 9. The main body portion 13 is of circular cross section and has a front face 14 which defines an air chamber 15. As shown in FIG. 2 the air chamber 15 has a centrally positioned aperture 17 that communicates with an airway 18 which in turn communicates with an airway 19 in the handle 11 via a spring loaded trigger valve 20. The base of the handle 11 has an internally threaded aperture 21 into which a source of compressed air may be coupled so that the air, on release of the trigger valve 20 can pass through the handle and airways 19 and 18 to the air chamber 15.

At the front face 14 of the main body portion 13 there is provided an annular support ring 22 that has planar rear and front faces 23 and 24 respectively. The support ring 22 has a projecting lug 25 on one side that is supported about a pin 26 between a pair of webs 27 that project from the handle adjacent the front surface 14 of the gun. The support ring 22 is thus secured to the gun for pivotal displacement from a closed position as shown in FIG. 2, to an open position as shown in FIG. 1 in which the ring is free to pivot downwardly away from air chamber 15.

A L-shaped latch member 28 is pivotally secured to the upper rear face of the body portion 13 via a pin 29. The latch member 28 has a forwardly extending portion that terminates in a tapered latch tongue 30 that locates in a cut-out 32 formed in the periphery of the support ring 22. The latch tongue 30 has a shoulder 31 that fits against the front face 24 of the ring to hold the ring in a closed position as shown in FIG. 2. The latch member 28 is urged by a spring (not shown) to the latched position shown in FIG. 2. By pressing the rear 33 of the latch member 28 as shown in FIG. 1, by force F the tongue 30 pivots clear of the cut-out 32 in the ring 22 thereby allowing the ring to pivot open.

A combined breech and nozzle assembly 35 has an internal cylindrical bore 36 which tapers divergingly towards the outer end 37 to define a nozzle portion 38. The internal cylindrical bore 36 defines a breech for a projectile (not shown). The combined breech and nozzle assembly 35 is detachably supported on the pneumatic gun by the support ring 22, an internal surface 39 of which is arranged to be a close sliding fit on a locating surface 40 formed on the exterior of the cylindrical portion of the breech. The support ring 22 locates against an annular shoulder 41 formed on an external frustoconical portion 42 which is parallel to a similarly shaped internal frustoconical annular surface 43 formed on the wall of the air chamber 15. The internal frustoconical surface 43 of the air chamber 15 is provided with an annular groove 44 in which a suitable o-ring 45 is positioned. The o-ring 45 is arranged to be in sealed engagement with the frustoconical surface 42 of the annular shoulder 41 of the breech/nozzle 35. The internal surface 39 of the support ring 22 is also provided with an annular groove 46 in which an o-ring 47 is located. The o-ring 47 forms a seal on the external periphery of the nozzle/breech assembly 35.

When the support ring 22 is unlatched to the open position, the breech/nozzle assembly 35 can be pushed off the ring by sliding the narrow end 37 through the ring 22. In this manner a number of different breech/nozzle assemblies may be supported by the ring, each having different external dimensions to correspond with different diameters of hose or tube with which the pneumatic gun is to be used.

In practice, a number of problems with the above described pneumatic gun have emerged. Firstly, the relative position of the handle 11 to the main body portion 13 necessitates a strong wrist action when the nozzle portion 38 of the breech/nozzle assembly 35 fitted to the gun is being forced into the end of a hose or tube. Because the handle 11 extends transversely below the body portion 13 with breech/nozzle assembly 35 attached thereto, a lever action is required to produce the force employed when pushing the nozzle into the hose or tube. The additional wrist action required quickly leads to operator fatigue.

Several problems have also arisen in connection with the operation of the support ring 22. When the support ring 22 is in an open position as shown in FIG. 1 there is nothing to prevent the ring from pivoting downwardly and squashing an operators finger resting on the trigger of the gun. Obviously this can be a painful experience and is an undesirable feature of the gun. More significantly, with the latching mechanism illustrated in FIGS. 1 and 2 it is possible to operate the gun without having the breech/nozzle assembly 35 properly seated in sealing engagement with the air chamber 15. In particular, due to the force required to push the external frustoconical portion 42 of the breech 35 into sealing engagement with the o-ring 45 in the internal frustoconical annular surface of the air chamber 15, it is possible for the support ring 22 not to be fully returned to its closed position so that the cut-out 32 does not properly locate behind the shoulder 31 on latch tongue 30. When this occurs the support ring 22 may remain in the partly closed position, held by the latch tongue 30, without the operator being aware, so that he may attempt to use the gun without having the breech sealed against the air chamber 15. Without the sealing engagement of the breech against the air chamber 15 it may not be possible to develop sufficient pressure behind the projectile to force it through the full length of the hose or tube connected to the nozzle. There is also a danger that the breech/nozzle assembly may be ejected under pressure of the compressed air, presenting a serious threat to the user's safety and possibly damage to the gun and other equipment.

A preferred embodiment of the improved pneumatic gun is illustrated in FIGS. 3 to 7 of the accompanying drawings. The pneumatic gun 50 comprises a handle 52 that is integral to a main body portion 54. The main body portion 54 has an air chamber 56, of circular cross section, provided in a front face thereof. The air chamber 56 has a centrally located aperture 58 that communicates with an airway 60, which in turn communicates with an airway 62 in one side of the main body portion 54, via a spring-loaded trigger valve assembly 64. As can be seen most clearly in FIGS. 4, 5 and 6, one side of the main body portion 54 has an internally threaded air inlet 66 in which a source of compressed air may be coupled so that the air, on release of the trigger valve, can pass through the airways 62 and 60 to the air chamber 56.

Figure 7:
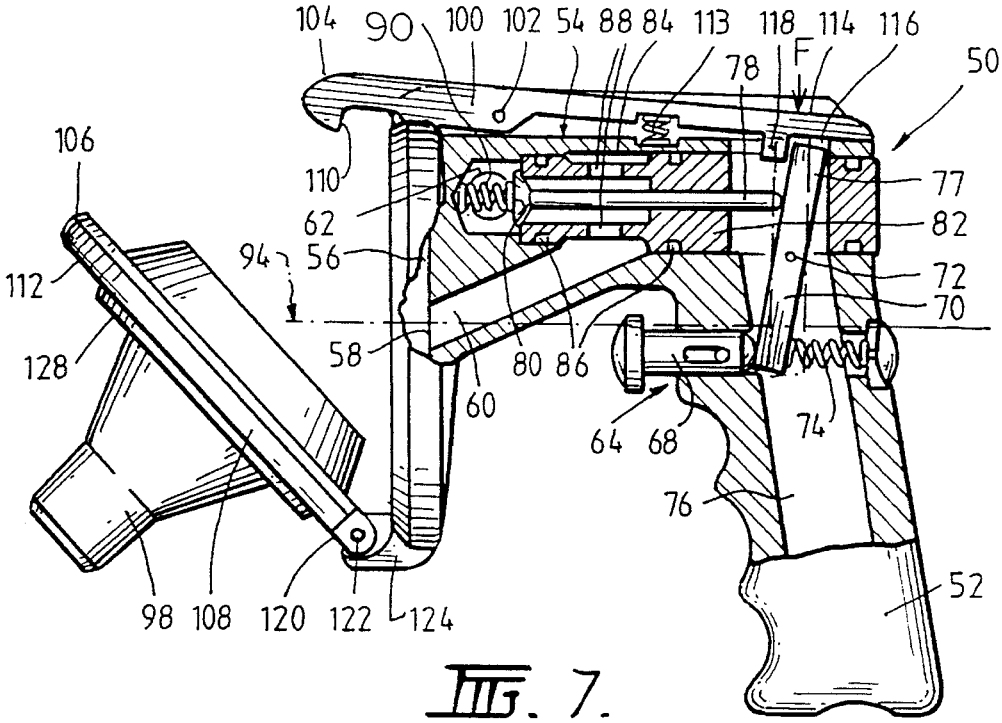
FIG. 7 is a partial cut-away view of the gun of FIGS. 3 to 6 with a breech/nozzle assembly attached.

Referring to FIG. 7, the trigger valve assembly 64 comprises a finger trigger 68 arranged to actuate a pivotable member 70 which is pivotally mounted within the hollow handle 52 and pivots at its lower end on a pin 72 extending transversely through the upper portion of handle 52. The finger trigger 68 is biased towards its non-actuated position by a coil spring 74 which bears against the side of the member 70 opposite to the trigger 68. Pivotable member 70 is able to pivot upon actuation of the trigger 68 within a hollow bore 76 provided in the handle 52. Adjacent an upper end 77, pivotable member 70 engages with the rear end of a valve stem 78 of a valve 80 of the trigger valve assembly 64.

The trigger valve assembly 64 further comprises a nylon sleeve 82 mounted within an internal bore 84 of the body portion 54 of the gun. Nylon sleeve 82 is provided with two annular grooves in its outer surface within which two o-rings 86 are received to provide a sealing relationship between the outer surface of the sleeve and the inner surface of the bore 84. A plurality of apertures 88 are provided in the side wall of the sleeve 82 to enable the passage of air from the exterior to the interior of the sleeve. The valve 80 is supported within a central bore of the sleeve 82 by valve stem 78 slidably received therein. The valve 80 is provided with a conical surface which tapers towards the valve stem 78 and is adapted to close off the open end of the sleeve 82. A coil spring 90 biases the valve 80 into sealing engagement with the mouth of the sleeve 82 to prevent the passage of air through the valve assembly 64. The valve 80 is illustrated in its normally closed position in FIG. 7.

When trigger 68 is depressed, pivotable member 70 pivots on pin 72 and the upper end 77 of the member urges against the valve stem 78 to open the valve 80, thus allowing the passage of compressed air through the airway 62, the mouth of the sleeve 82, apertures 88 and airway 60 to the air chamber 56.

The hand grip provided on the handle 52 is designed for operator convenience and facilitates easy actuation of the trigger valve by depressing the trigger 68. Furthermore, the grip on handle 52 is arranged so that an operator's hand gripping the handle can at least partially overlie a central axis 94 of the air chamber 56 and the breech 96 in its sealed position. This configuration ensures that little or no wrist lever action is required when pushing a nozzle 98 into the end of a hose or tube, since the force required to push the nozzle into the end of the hose or tube can be applied directly along axis 94 with little or no lever action on handle 52.

Figure 3:
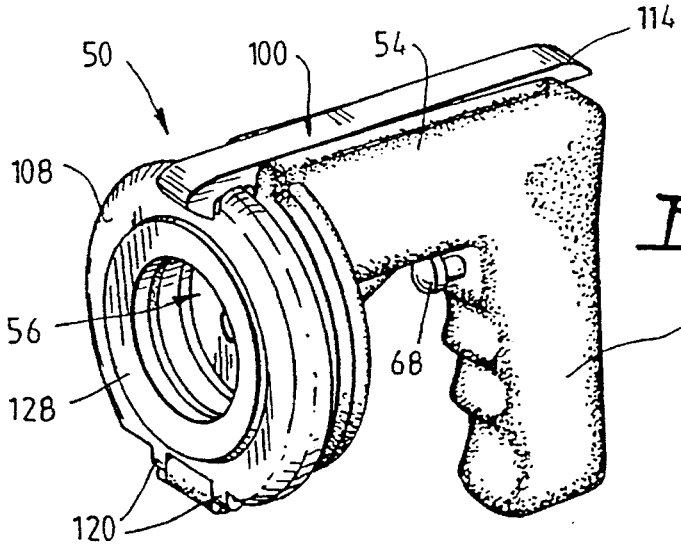
FIG. 3 is a perspective view of a preferred embodiment of the improved pneumatic gun with a support ring in its latched position.
Figure 5:
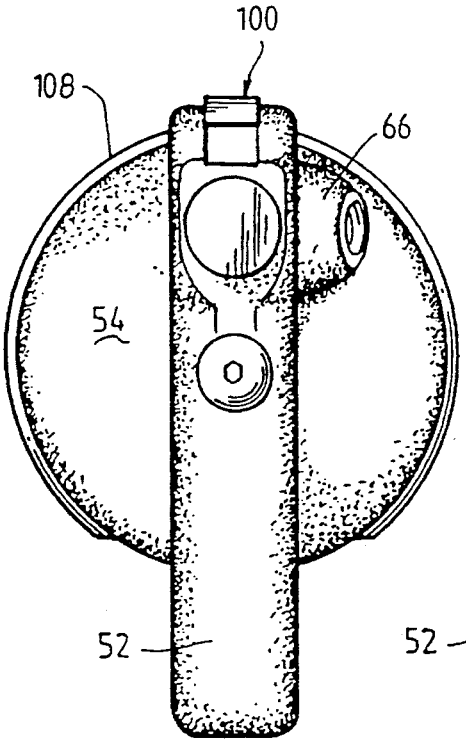
FIG. 5 is a rear view of the gun of FIG. 3.
Figure 4:
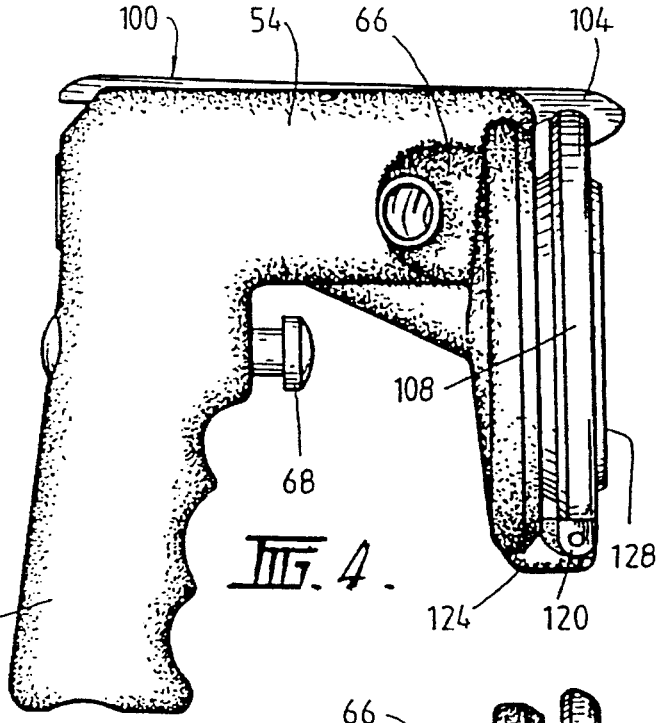
FIG. 4 is a side view of the gun of FIG. 3.

A latch member 100 is pivotally secured to the upper face of the main body portion 54 via a pin 102. The latch member 100 is provided with a forwardly extending portion 104 that locates in a cut-out 106 formed in the periphery of the support ring 108 similar to that of the gun illustrated in FIGS. 1 and 2. The forwardly extending portion 104 of latch member 100 is provided with a shoulder 110 that fits against the front face 112 of the ring to hold the ring in a closed position as shown in FIGS. 3 and 4. The latch member 100 is urged by a spring 113 to the latched position shown in FIGS. 3 and 4. By pressing down on the rear end 114 of the latch member 100 as shown by force F the forwardly extending portion 104 pivots clear of the cut-out in the support ring 108 thereby allowing the ring to pivot open.

Spring 113 is seated in matching recesses formed in the underside of latch 100 and the upper face of body portion 54 respectively. An interlocking assembly 116, comprising a lug 118 integral to and on the underside of latch member 100 extends downwardly at a location where it will engage the upper end 77 of the pivotable member 70, when the latter is pivoted by actuation of the trigger 68. As illustrated in FIG. 7, the trigger 68 is in its rest position so that the upper end 77 of pivotable member 70 does not engage with the interlocking protrusion 116, even when the latch member 100 is pivoted to its unlatched position as shown in FIG. 7. However, with the latch member 100 in its unlatched position as shown, the operator is unable to actuate the trigger valve by gripping the trigger 68, since the upper end 77 of the pivotable member will engage the lug 118 provided on the underside of the latch member 100. Thus, actuation of the trigger valve assembly 64 to allow the passage of compressed air can be inhibited by the interlocking assembly 116 comprised, in this embodiment, by lug 118 and the upper end 77 of the pivotable member 70.

Thus, if the latch member 100 is not in its fully latched position, for example because support ring 108 has not been fully returned to its closed position so that shoulder 110 is seated in the cut-out 106 rather than against the front face 112 of the ring, the interlocking assembly 116 interlocks with the trigger valve 64 whereby actuation of the trigger valve to allow passage of compressed air into the breech 96 is prevented. Thus the operator will be alerted to the fact that the breech is not properly seated in sealing engagement against the air chamber 56. The seating of the breech 96 within the air chamber 56 is substantially identical to that of the gun illustrated in FIGS. 1 and 2, and will not be described again here.

In this embodiment the interlocking assembly 116 is provided by an interlocking arrangement between the pivotable member 70 and the latch member 100. Latch member 100 is provided with a downwardly protruding lug 118 designed to engage with the upper end 77 of the pivotable member 70 if the latch member 100 is not in its fully latched position. Thus, if the rear end 114 of the latch member 100 is pivoted slightly downwards, lug 118 will engage the upper end 77 of the pivotable member 70 preventing pivoting movement thereof. Clearly, alternative forms of interlocking assembly could be employed, such as would be obvious to the skilled addressee, to provide the equivalent mechanical function.

Figure 6:
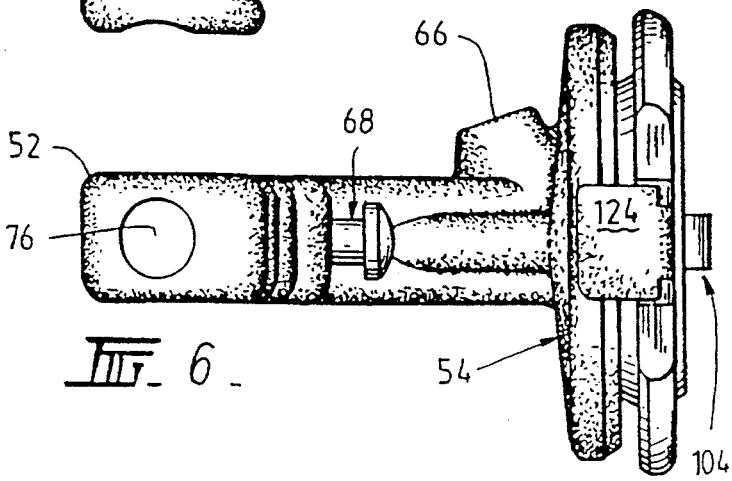
FIG. 6 is a bottom view of the gun of FIG. 3.

Support ring 108 is pivotally attached to the main body portion 54 of the gun via a pair of webs 120 and a pin 122 in a similar arrangement to that of the gun illustrated in FIGS. 1 and 2. However, as shown in FIGS. 4, 6 and 7 the main body portion 54 is provided with a lip 124 immediately adjacent the pivot pin 122 of the support ring, designed to limit the extent to which the support ring can pivot open when released by latch member 100. By limiting the extent to which the support ring can pivot downwards lip 124 minimises the possibility of injury to the operator. A further advantage provided by lip 124 is that it provides a support surface on which the support ring 108 can be rested when inserting a substitute nozzle for difference sized tube or hose.

To operate the gun, a source of compressed air typically at between 100 to 140 lbf/sq.in. is coupled to the inlet 66 of the gun. A specially designed projectile in the form of a polymer pellet that is typically twenty percent larger than the internal diameter of the tube or hose that is to be cleaned is positioned to be a close fit within the breech 96. A projectile is loaded into the breech 96 by releasing the support ring 108 by use of the latch 100, positioning a projectile into the rear of the breech/nozzle and then closing the ring 108 against the latch 100. It is necessary to ensure that the ring 108 is fully returned to its closed position with the shoulder 110 resting against the front face 112 of the ring as described above, or the interlocking assembly 116 will prevent actuation of the trigger valve. The free end 98 of the breech/nozzle is then coupled to the line in question and the trigger valve 64 actuated causing compressed air to flow into the air chamber 56 against the end surface of the projectile in the breech 96. The air pressure forces the projectile to escape through the nozzle 98 into the line, to be forced along the length of the line to remove all internal contamination. The use of a detachable breech/nozzle in the support ring 108 allows the gun to be used with a large variety of sizes of pellets.

Figure 8A:
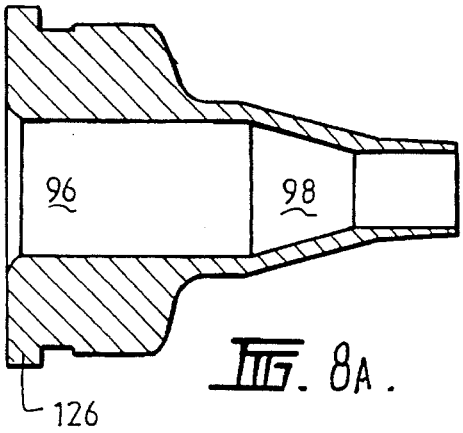
FIGS. 8(A), (B) and (C) illustrate three different breech/nozzles for the gun in section view.

In order to launch the pellets into different sized hose or tubes a plurality of detachable breech/nozzles are provided to couple the gun to the line in question. FIGS. 8(A), (B) and (C) and FIG. 9 illustrate four different sized breech/nozzles for launching different size projectiles into the hose or tube. The projectile or pellet is inserted into the breech which is then located in its sealed position against the air chamber 56 of the gun. Assuming the support ring 108 has been returned to its fully closed position, when the trigger 68 is actuated compressed air forces the projectile into the nozzle 98. As the projectile is delivered under pressure into the end of the hose or tube, it is constrained at the point of entry and is launched into the hose or tube in a compressed state. As the projectile enters the end of the hose or tube it may subsequently expand slightly, but it remains in a substantially compressed state on its travel through the hose or tube.

Figure 8B:
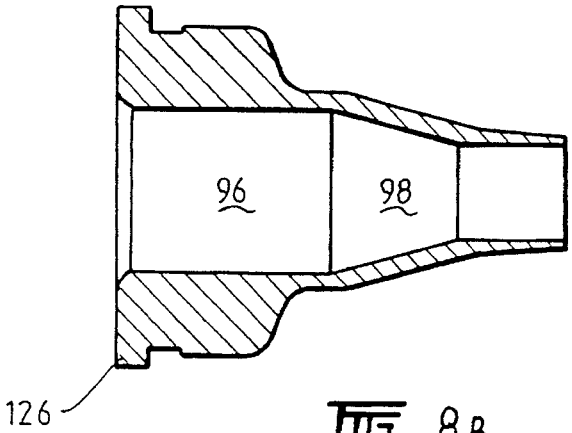
Figure 8C:
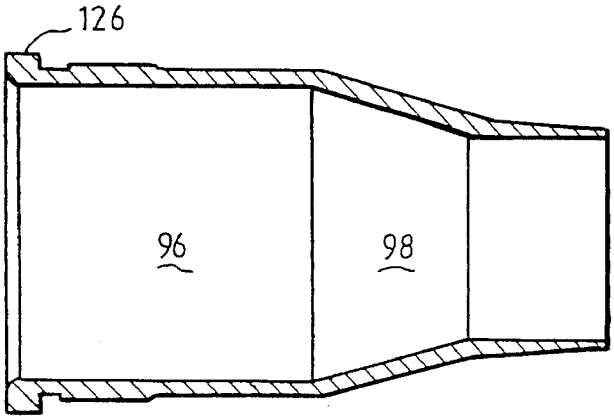

The breech 96 of the nozzles illustrated in FIG. 8 has been modified to reduce the amount of metal used and thus decrease the overall weight of the breech/nozzles. The breech 96 of each nozzle is provided with an external annular lip 126 of reduced diameter compared to the breech on the nozzles employed with the gun described in U.S. Pat. No. 4,974,277. The previous nozzles all had a breech with external diameter designed to fit tightly in the air chamber 56 of the gun. However, with the smaller diameter nozzles this resulted in a heavy lump of metal required to form the breech of larger diameter, which in turn added to the overall weight of the gun. In order to attach the new breech/nozzles to the gun an adaptor ring 128 (see FIG. 10) is provided which engages with the lip 126 and which has an external diameter and profile sized to be received in the air chamber 56 and the support ring 108 of the gun. An outer peripheral surface 129 of the adaptor ring 128 is designed to be received in a snug fit in support ring 108. Adaptor ring 128 is preferably made of acetal which is a synthetic material of comparatively light-weight compared to the metal of the breech/nozzles, and therefore helps to substantially reduce the overall weight of the breech/nozzles and the gun in use. FIG. 10(A) illustrates the adaptor ring 128 in section view, and FIG. 10(B) is an enlargement of part of FIG. 10(A). An annular groove is provided on an inner surface of the adaptor ring, within which an o-ring 130 is received to provide an air-tight seal between the adaptor ring and a breech/nozzle received therein. The gun illustrated in FIGS. 3 to 7 has the adaptor ring 128 fitted thereto.

The breech/nozzle assembly illustrated in FIG. 9 is similar to that employed with the gun described in U.S. Pat. No. 4,974,277, in that the external diameter of the breech 96 is only slightly smaller than the internal diameter of the air chamber 56 of the gun. However, the profile of an outer peripheral surface 97 of the breech 96 has been modified to be similar to the peripheral surface 129 of the adaptor ring 128 to provide a sealing fit in support ring 108.

Various types of breech/nozzle assemblies may be employed with the pneumatic gun, made from stainless steel or nylon or other plastics material to suit various diameters of hose, tube or pipe. A breech/adaptor assembly may also be employed to suit a hose with end fitting or coupling, which is adapted to connect to the coupling. The pneumatic gun can also be used for firing a projectile with a string attached thereto through a conduit, which string can then be used to pull electrical cabling through the conduit. The breech/nozzle assembly is provided with means for feeding a string, for example, a light weight nylon string which is attached to the projectile, as it is fired through the conduit. In this application, the projectile is selected to be slightly smaller in diameter than the internal diameter of the conduit. This application of the pneumatic gun may be particularly useful where electrical cabling must be passed through a conduit having several bends or corners in it which would be impossible to negotiate using conventional techniques.

The preferred embodiment of the gun can typically be used with pellets ranging from, 4 mm to 60 mm in diameter. The pellets are typically made from polyurethane foam fragments bonded together with contact cement to form a sheet of rebond foam, or from a sheet of virgin foam, from which cylindrical pellets of the diameters described above can be cut. The length of each pellet varies from between 20 to 100 mm depending on the thickness of the sheet of foam from which the pellets are cut. The polyurethane foam fragments are cut to a size and bonded together to form different densities of rebond foam, in the range C-30 to C-140 density. High density rebond foam is employed to form the pellets employed in the pneumatic gun, typically in the range C-110 to C-140. Alternatively, high density virgin foam of a similar density is employed to manufacture the pellets. High density foam is preferred in order to provide sufficient friction between the projectile and the wall of the tube or hose to remove all contaminants and also to prevent air from passing through the pellets.

To further aid in the removal of contaminants an abrasive layer may be bonded to the foam sheet from which the projectiles are cut to form pellets with an abrasive layer on the front or rear surface thereof, as illustrated in FIG. 11. FIG. 11 shows a pellet 131 made of polyurethane foam 132 and an abrasive layer 134 provided at one end thereof. The abrasive layer 134 is typically made from fibrous nylon or other plastics material similar to that used in the manufacture of scourers for domestic cleaning. The pellets may be formed with two or more abrasive layers 134 as illustrated in FIG. 12, by cutting the pellets from laminated sheets of alternate layers of foam and abrasive material. The pellets can also be manufactured with an abrasive layer in the form of a coating of, for example, carborundum, applied to the whole or part of the external surface of the pellet.

FIG. 13 illustrates a still further embodiment of a projectile which may be used with the above described gun, in which the cylindrical portion 132 of the projectile is characterised in that it consists of a plurality of layers of foamed plastics material, each layer having a different density from its adjacent layer. In this embodiment the layers extend substantially perpendicular to the normal direction of travel of the projectile and are all substantially parallel. Advantageously the layers can be laminated in order of increasing or decreasing density to suit different applications. Typically the density of the layers of foamed plastics material varies in the range 80 to 200 $Kgm^3$.

The range of densities is constrained by several factors. Firstly, if the overall density of the projectile is too low the compressed air will pass through the projectile rather than pushing the projectile through the hose or tube. On the other hand, if the density of the foamed plastics material is too high the projectile cannot be compressed in the nozzle and will not be launched into the end of the hose or tube. Furthermore, if the density of the projectile is too high it will not be able to negotiate bends and other discontinuities in the hose or tube. Obviously, the projectile may have two or more layers laminated together. The projectiles can also be disinfected, sterilised or lubricated and then seal-packed for use in various applications which require high standards of cleanliness and purity. Advantageously the absorbent properties of the foamed plastics material employed for the projectiles means they can be charged with a suitable reagent to facilitate cleaning and/or coating of the internal surfaces of the tube or hose through which they travel.

The projectiles can also be provided with one or more annular grooves 136 in the outer circumferential surface thereof to act as a trap for contaminants as they pass through the hose or tube.

The gun and projectiles of the present invention have numerous applications in the following non-exhaustive list of industries:

| | | | |
|---|---|---|---|
| 1. | Hydraulics | 8. | Painting |
| 2. | Pneumatics | 9. | Desalination |
| 3. | Food and Beverage | 10. | Descaling |
| 4. | Powder Coating | 11. | Rust proofing |
| 5. | Cleaning and oiling of gun barrels | 12. | Air conditioning |
| | | 13. | Refrigeration |
| 6. | Plumbing and irrigation | 14. | Gas (fitting servicing) |
| 7. | Medical | | |

Depending on the application, the gun can be manufactured from any suitable materials, for example, cast aluminium alloy, stainless steel, or rigid plastics and other synthetic materials.

From the above description of a preferred embodiment of the invention it will be apparent that the improvements to the pneumatic gun and projectiles provide significant advantages over the previous gun. A further advantage not mentioned above is the significant reduction in the overall weight of the gun which has been achieved by reducing the dimensions of the body portion 54 and by providing the hollow bore 76 in the handle 52 of the gun. It will also be apparent to those skilled in the relevant arts that numerous further modifications and variations may be made to the described embodiment without departing from the basic inventive concepts. For example, although in the preferred embodiment the breech is supported in sealing engagement against the air chamber 56 by a support ring 108 pivotally secured to the body of the gun, this is by no means the only arrangement for supporting the breech. For example, the support ring need not be pivotally secured to the gun, but may instead be held by two or more latches similar to the latch member 100. Indeed, the support ring could be dispensed with altogether using a plurality of latches or clamps to hold the breech by its periphery against the air chamber. The skilled addressee could readily modify the interlocking assembly described above to provide a similar safety mechanism for these alternative arrangements. All such modifications and variations are to be considered within the scope of the present invention the nature of which is to be determined from the foregoing description and the appended claims.

I claim:

1. A projectile for a hand held pneumatic gun, the projectile comprising:

a cylindrical portion of high density foamed plastics material having an outside diameter falling within the range 4 mm to 60 mm inclusive, the projectile being adapted to be pushed by compressed air through a tube of slightly less diameter than the cylindrical portion, the foamed plastics material having a density that falls in the range of 80 to 200 kg/m$^3$ to provide sufficient friction between the projectile and the wall of the tube to remove contaminants and also to substantially prevent air from passing through the projectile whereby, in use, the inner surface of the tube can be substantially cleaned of contaminants, said projectile being in the form of a pellet wherein one or more layers of abrasive material is bonded to the cylindrical portion to enhance the cleaning properties of the pellet.

2. A projectile as defined in claim 1, wherein a first layer of abrasive material is bonded to a front face of the cylindrical portion of the pellet, in a plane substantially perpendicular to the normal direction of travel of the pellet.

3. A projectile as defined in claim 1, wherein a layer of abrasive material in the form of an abrasive coating is applied to an outer circumferential surface of the cylindrical portion of the pellet.

4. A projectile as defined in claim 1, further comprising an annular groove provided in an outer circumferential surface of the cylindrical portion of the pellet, said groove, in use, acting as a trap for contaminants.

5. A projectile for a hand held pneumatic gun, the projectile comprising:

a cylindrical portion of high density foamed plastics material having an outside diameter falling within the range 4 mm to 60 mm inclusive, the projectile being adapted to be pushed by compressed air through a tube of slightly less diameter than the cylindrical portion, the foamed plastics material having a density that falls in the range of 80 to 200 kg/m$^3$ to provide sufficient friction between the projectile and the wall of the tube to remove contaminants and also to substantially prevent air from passing through the projectile whereby, in use, the inner surface of the tube can be substantially cleaned of contaminants, and said projectile being in the form of a pellet wherein the cylindrical portion of foamed plastics material is a plurality of longitudinally divided layers, each said layer having a different density from an adjacent layer so that each said layer provides a different frictional cleaning effect on the wall of the tube as the pellet passes thereby.

6. A projectile as defined in claim 5, wherein said layers extend substantially perpendicular to the normal direction of travel of the projectile.

7. A projectile as defined in claim 6, wherein said layers are laminated in order of increasing or decreasing density.

8. A projectile as defined in claim 5 further comprising an annular groove provided in an outer circumferential surface of the cylindrical portion of the pellet, said groove, in use, acting as a trap for contaminants.

9. A projectile for a hand held pneumatic gun, the projectile comprising:

a cylindrical portion of high density foamed plastics material having an outside diameter falling within the range 4 mm to 60 mm inclusive, the projectile being adapted to be pushed by compressed air through a tube of slightly less diameter than the cylindrical portion, the foamed plastics material having a density that falls in the range of 80 to 200 kg/m$^3$ to provide sufficient friction between the projectile and the wall of the tube to remove contaminants and also to substantially prevent air from passing through the projectile whereby, in use, the inner surface of the tube can be substantially cleaned of contaminants, and wherein a layer of abrasive fibrous plastics material is bonded to a face of the cylindrical portion in a plane lying substantially perpendicular to the normal direction of travel of the projectile through the tube.

10. A projectile as defined in claim 9, wherein the high density foamed plastics material is manufactured from rebond foam.

11. A projectile for a hand held pneumatic gun, the projectile being in the form of a pellet and comprising:

a cylindrical portion of high density foamed plastics material having an outside diameter falling within the range 4 mm to 60 mm inclusive, wherein the foamed plastics material is a plurality of layers with each said layer having a different density from an adjacent layer and with said layers extending substantially perpendicular to the normal direction of travel of the projectile, the projectile being adapted to be pushed by compressed air through a tube of slightly less diameter than the cylindrical portion, the density of the foamed plastics material being selected to provide sufficient friction between the projectile and the wall of the tube to remove contaminants and also to substantially prevent air from passing through the projectile whereby, in use, the inner surface of the tube can be substantially cleaned of contaminants.

12. A projectile as defined in claim 11, wherein said layers are laminated in order of increasing or decreasing density.

* * * * *